US005727480A

United States Patent [19]

Garcia-Mallol

[11] Patent Number: 5,727,480

[45] Date of Patent: Mar. 17, 1998

[54] OVER-FIRE AIR CONTROL SYSTEM FOR A PULVERIZED SOLID FUEL FURNACE

[75] Inventor: Juan Antonio Garcia-Mallol, Morristown, N.J.

[73] Assignee: Foster Wheeler International, Inc., Clinton, N.J.

[21] Appl. No.: 634,107

[22] Filed: Apr. 17, 1996

[51] Int. Cl.[6] ..... F23J 15/00

[52] U.S. Cl. ..... 110/203; 110/265; 110/261; 431/10; 431/188; 431/190

[58] Field of Search ..... 110/261, 263, 110/265, 297, 309, 313, 345, 348, 347, 203; 431/2, 5, 10, 190, 181, 188

[56] References Cited

U.S. PATENT DOCUMENTS

| | | | |
|---|---|---|---|
| 3,261,333 | 7/1966 | Jonakin . | |
| 3,788,796 | 1/1974 | Krippene et al. . | |
| 3,984,196 | 10/1976 | Zenkner | 431/5 |
| 4,095,935 | 6/1978 | Menegaz et al. . | |
| 4,442,783 | 4/1984 | Pajonas et al. . | |
| 4,501,204 | 2/1985 | McCartney et al. . | |
| 4,748,919 | 6/1988 | Campobenedetto et al. . | |
| 5,107,776 | 4/1992 | Garcia-Mallol . | |
| 5,199,357 | 4/1993 | Garcia-Mallol . | |
| 5,231,937 | 8/1993 | Kobayashi et al. | 110/263 X |
| 5,237,963 | 8/1993 | Garcia-Mallol . | |
| 5,343,820 | 9/1994 | Marion . | |
| 5,441,000 | 8/1995 | Vatsky et al. | 110/265 |
| 5,601,425 | 2/1997 | Kobayashi et al. | 431/190 X |
| 5,626,085 | 5/1997 | Donais et al. | 110/263 X |

FOREIGN PATENT DOCUMENTS

| | | | |
|---|---|---|---|
| 2048456 | 12/1980 | United Kingdom | 431/10 |

*Primary Examiner*—Henry A. Bennett
*Assistant Examiner*—Susanne C. Tinker
*Attorney, Agent, or Firm*—Haynes and Boone L.L.P.

[57] ABSTRACT

An over-fire air control system for a pulverized fuel furnace, in which a burner assembly is provided for discharging a fuel/primary air mixture along with secondary air to combust the fuel. The amount of primary air and secondary air discharge is controlled to achieve incomplete combustion, and an overfire air port is provided through which additional air is discharged to complete the combustion. The overfire air port receives two streams of air, one high in volume and low in velocity and the other low in volume and high in velocity. Dampers are provided for controlling the air streams to achieve optimum quantifies and velocities of the air. According to one embodiment, a source of one of the air streams is the primary air portion of the fuel/primary air mixture applied to the burner assembly. As a result, the formation of nitrous oxides are reduced and fairly precise air fuel ratios can be maintained despite variations in the quality of the fuel and the pressure and amount of primary air.

15 Claims, 2 Drawing Sheets

OVER-FIRE AIR CONTROL SYSTEM FOR A PULVERIZED SOLID FUEL FURNACE

BACKGROUND OF THE INVENTION

The present invention relates to a control system for a furnace for combusting pulverized solid fuel, and, more particularly, to an over-fire air control system for introducing air into the furnace to support the combustion.

Pulverized coal furnaces employ a plurality of burners which inject a pulverized solid fuel, such as coal or coke, into the interior of the furnace where the fuel is ignited and combusted to produce heat. The fuel is usually delivered to the furnace suspended in air, which is referred to as "primary air," and additional "secondary" air is also introduced into the furnace adjacent the stream of fuel and primary air in a combustion-supporting relationship to the fuel.

These types of furnaces are often subject to regulations limiting the amount of nitrous oxides that can be discharged into the atmosphere. Thus, techniques that reduce the amount of nitrous oxides produced in the combustion process have evolved, including diverting a portion of the secondary air from the burners to over-fire air ports extending through the furnace wall downstream of the burner, and introducing a portion of the secondary air into the furnace through these ports. The amount of air diverted to the over-fire air ports is controlled so that the initial combustion of the fuel occurs at sub-stoichiometric conditions to create a reducing atmosphere which minimizes the formation of nitrous oxides, with the remaining air required for complete combustion being furnished at the over-fire air ports. The systems for supplying and controlling the flow of the diverted secondary air to and through the over-fire air ports vary and often include burner-like nozzles, or the like, for introducing the over-fire air, as well as swirling vanes, separate blowers and other associated equipment, resulting in installations that are complex and expensive.

In these arrangements, the establishment of a fairly precise ratio of fuel to primary air is important to establish and maintain efficient ignition and combustion, especially when over-fire air systems are used. However, in installations involving a multitude of burners, the amount of primary air available at a given time often varies along with the quality of the fuel, making it difficult to establish optimum fuel/primary air ratios. The addition of the over-fire air systems, with their inherent complexity and expense, exacerbate these problems.

Therefore, what is needed is an over-fire air control system for a pulverized coal furnace which reduces the formation of nitrous oxides yet is relatively simple in design, does not require an abundance of complex and expensive associated equipment, and maintains optimum fuel-air ratios despite variances in the quality of the fuel and the amount of available primary air.

SUMMARY OF THE INVENTION

The present invention, accordingly, provides an over-fire air control system for a pulverized fuel furnace, and a method of operating such a furnace, in which the formation of nitrous oxides are reduced and fairly precise air fuel rations can be maintained despite variations in the quality of the fuel and the amount of primary air. To this end, according to the present invention, a burner assembly is provided for discharging a fuel/primary air mixture along with secondary air to combust the fuel. The amount of primary air and secondary discharged is controlled to achieve incomplete combustion, and an overfire air port is provided through which additional air is discharged to complete the combustion. The overfire air port receives two streams of air, one high in volume and low in velocity and the other low in volume and high in velocity. Dampers are provided for controlling the air streams to achieve optimum quantities and velocities of the air. According to one embodiment, the source of one of the air streams is the primary air portion of the fuel/primary air mixture applied to the burner assembly.

Major advantages are achieved with the over-fire air port control system and combustion method of the present invention since precise fuel-air ratios can be maintained despite variations in fuel quality and the quantity of available air, while the formation of nitrous oxides is minimized. Also the system is relatively simple, does not require complex associated equipment, and is relative inexpensive to install and operate.

DESCRIPTION OF THE PREFERRED EMBODIMENT

Figure 1:
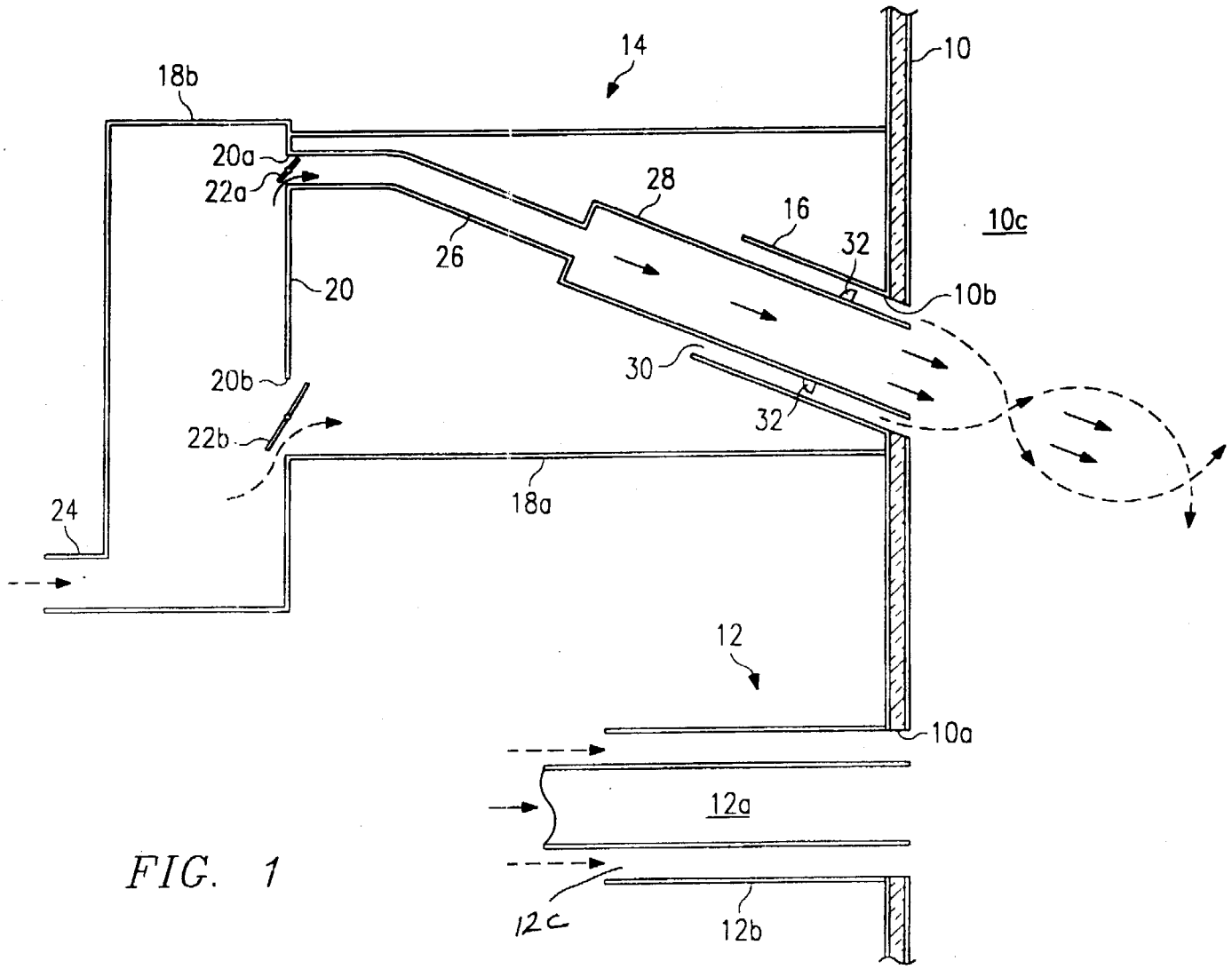
FIG. 1 is a cross sectional view of a furnace employing the over-fire air system of the present invention.

Referring to FIG. 1 of the drawings, the reference numeral 10 refers in general, to an upright wall of a pulverized solid fuel furnace. It is understood that the furnace is defined by three other upright walls, a roof, and a floor (all not shown). Preferably the walls are formed by a plurality of water tubes disposed in a spaced relation and having continuous fins extending therebetween to form a gas-tight enclosure. Two spaced openings, or ports, 10*a* and 10*b* extend through the wall 10 and communicate with the interior 10*c* of the furnace. The ports 10*a* and 10*b* are located a predetermined height in the furnace between its floor and its roof.

A burner assembly, shown in general by the reference numeral 12, is provided and includes a burner 12*a* registering with the port 10*a* for discharging a mixture of pulverized fuel, such as coal, and primary air into the interior 10*c* of the furnace. A sleeve 12*b* also registers with the port 10*a* and surrounds the burner 12*a* to define an annular passage 12*c* which receives pressurized secondary air from a secondary air plenum, or windbox (not shown). It is understood that ignitors, or the like (not shown) are provided to initially ignite the fuel and that dampers, vanes and the like could be provided in the annular passage 12*c* for receiving and controlling the flow of secondary air into the furnace interior 10*c* in a combustion-supporting relationship with the fuel discharging from the burner 12*a*, all in a conventional manner. The combustion products generated by the continuous combustion of the fuel flow upwardly in the furnace interior 10*a* by natural convection. Since the burner assembly 12 does not form a part of the present invention, it will not be described in any further detail.

The over-fire air control system of the present invention is shown, in general, by the reference numeral 14 and includes a sleeve 16 extending at an angle to the wall 10 and in registry with the port 10*b*. The sleeve 16 extends into an air plenum 18*a* which extends to the wall 10 and which connects to an additional air plenum 18*b*. A common wall 20 separates the two plenums 18*a* and 18*b* and has two spaced air flow openings 20*a* and 20*b* extending therethrough in which are disposed two dampers 22*a* and 22*b* for controlling the flow of air through the openings for reasons to be described.

A secondary air duct 24 registers with an opening in a wall of the plenum 18b for introducing secondary air from the above-mentioned secondary air plenum, or windbox, into the plenum 18b. The air in the plenum 18b thus passes into the plenum 18a under control of the dampers 22a and 22b. A duct 26 has one end in registry with the opening 20a and the other end in registry with the inlet end of a nozzle 28, for passing air from the plenum 18b into the nozzle under control of the damper 22a. The other end of the nozzle 28 extends within, and in a coaxial relationship with, the sleeve 16 and in registry with the port 10b. Thus, the air from the nozzle 28 discharges into the furnace interior 10c at an area above the location where the fuel/primary air mixture and the other quantity of secondary air is discharged.

The outer diameter of the nozzle 28 is less that the diameter of the sleeve 16 to define an annular passage 30 for receiving air from the plenum 18a under control of the damper 22b. A plurality of swirl vanes 32 are angularly spaced around the annular passage 30 for imparting a swirl to the air passing through the passage before the air discharges into the furnace interior 10c. To this end, it is understood that the vanes can be adjustable to vary the swirl, in a conventional manner.

It is understood that the sleeve 16 and the nozzle 28 are mounted relative to the wall 10, and the duct 26 is mounted to the wall 20, in a conventional manner. Also, the the dampers 22a and 22b and the swirl vanes 32 can be manually controlled or remotely actuated, in accordance with known techniques.

In operation, a mixture of primary air and pulverized solid fuel, such as coal, is introduced into the burner 12a in the direction shown by the solid flow arrow, and secondary air is introduced into the passage between the nozzle 12a and the sleeve 12b, as shown by the dashed flow arrows. The mixture of the fuel and the primary air, as well as the secondary air, discharge into the furnace interior 10c and the fuel is initially ignited to cause continuous combustion of the fuel, with the primary air and the secondary air supporting the combustion. The amount of secondary air introduced in this manner is carefully controlled so that is less than stoichiometric, causing incomplete combustion of the fuel under reducing conditions which minimizes the formation of nitrous oxides. The combustion gases, along with the incompletely combusted fuel, rise in the furnace interior 10c towards the over-fire air control system 14.

Additional secondary, or overfire, air from the same source that supplies the secondary air to the burner assembly 12, is introduced into the overfire air control system 14 through the air duct 24 as shown by the dashed flow arrow. The air thus passes into the plenum 18b and through the openings 20a and 20b under control of the dampers 22a and 22b. The air passing through the opening 20a enters the duct 26 and passes to the nozzle 28 for discharge into the furnace interior 10c through the port 10b. The air passing through the opening 20b enters the plenum 18a, passes through the annular passage 30, and is swirled by the vanes 32 before discharging into the furnace interior 10c in a flow stream surrounding the flow stream of air from the nozzle 28. The design is such that the discharge area of the nozzle 28, defined by its diameter, is greater than the discharge area of the annular passage 30. As a result, the secondary air discharging into the furnace interior from the nozzle 28 is relatively high in volume and low in velocity, while the air from the passage 30 discharging into the furnace interior 10c is relatively low in volume and relatively high in velocity.

The dampers 22a and 22b are adjusted so that the total volume of the overfire air introduced into the furnace interior 10c through the port 10b is sufficient to complete the combustion of the fuel.

According to a feature of the present invention, the quantity and/or velocity of the overfire air introduced through the port 10b in the above manner can be controlled to achieve optimum operating conditions despite variations in the quantity and/or velocity of the available air. For example, if the velocity of the overfire air provided at the duct 24 is relatively low, the damper 22a can be moved towards its closed position and the damper 22b moved towards its open position. This directs a majority of the air from the plenum 18b through the opening 20b and the passage 30 causing the air to discharge into the furnace interior 10c at an increased velocity sufficient to complete the combustion of the fuel under optimum conditions. On the other hand, if an increased volume of air is needed, the damper 22b is moved towards its closed position and the damper 22a is moved towards its open position causing a majority of the air from the plenum 18b to pass through the opening 20a, the duct 26 and the nozzle 28 causing a relatively high-volume discharge into the furnace interior 10c.

It is understood that the flow of the overfire air through the over-fire air ports can be analyzed and treated accordingly by applying the jet principles disclosed in the following two articles, the disclosures of which are incorporated by reference:

(1) N. A Chigier and J. M. Beer, 1963 as quoted by J. Chedaille, W. Leuchkel and A. K. Chesters "Aerodynamic Studies Carried Out on Turbulent Jets by the International Flame Research Foundation (Ijmuiden) "3rd Flames and Industry Symposium, London, England, Oct. 19, 1966;

(2) N. M. Kerr and D. Fraser "Swirl Part 1: Effect on Axisymmetrical Turbulent Jets," Journal of the Institute of Fuel, Volume 39, December 1965.

It should be noted that, in the formulas set forth in the above articles, it is necessary to multiply the swirl number by the square root of the ratio of air density in the overfire air port 10b to the gas density in the interior 10c of the furnace. Also, the jet axial velocity should not substantially exceed the gas velocity in the furnace above the port 10b, and the jet should draw all of the furnace gas coming from below the port 10b at the depth of the furnace interior 10c. Several advantages result from the foregoing. For example, the over-fire air control system of the present invention reduces the formation of nitrous oxides yet is relatively simple in design, and does not require an abundance of complex and expensive associated equipment. Also the amount and velocity of the overfire air provided at the overfire air port 10b can be precisely controlled despite variances in the amount and pressure of the available air, as discussed above.

Figure 2:
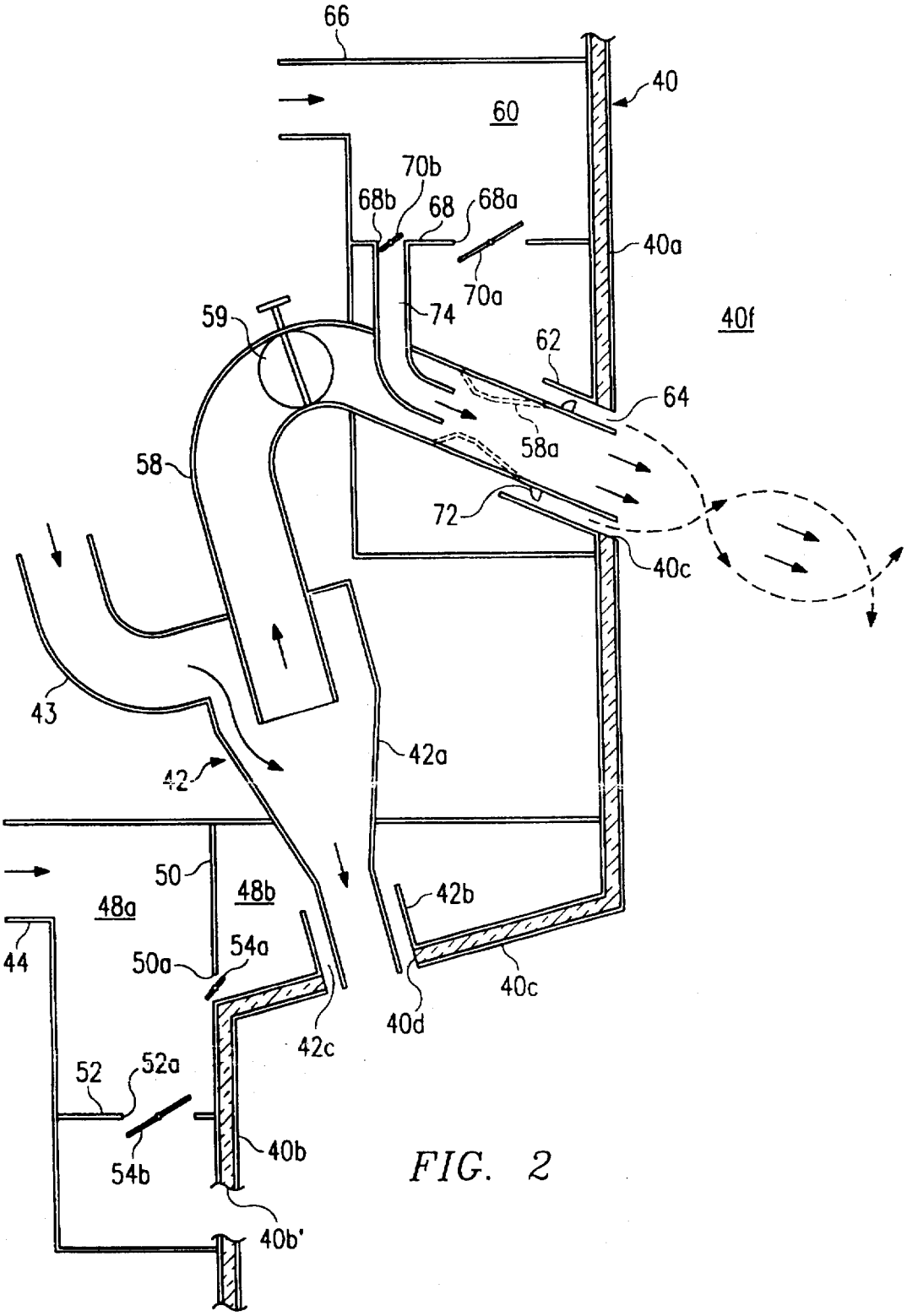
FIG. 2 is a view similar to FIG. 1, but depicting an alternate embodiment of the system of the present invention.

The system of the present can also be used in connection with an arch-fired furnace as shown in the embodiment of FIG. 2. The arch-fired furnace has an upright front wall 40 consisting of an upper vertical portion 40a, a lower vertical portion 40b and an angled portion 40c extending at an acute angle to the horizontal and connecting the upper vertical portion 40a to the lower vertical portion 40b. It is understood that the furnace is defined by a rear wall which is a mirror image of the front wall 40, two sidewalls, a roof, and a floor (all not shown) and that each wall can be formed by a plurality of water tubes as discussed in connection with the embodiment of FIG. 1, to form a gas-tight enclosure, in a conventional manner. An opening, or port, 40d extends through the wall portion 40c and an opening, or port, 40c extends through the wall portion 40a. Both of the ports 40d and 40c communicate with the interior 40f of the furnace and are located a predetermined height in the furnace between its floor and its roof.

A cyclone burner assembly, shown in general by the reference numeral 42, is provided and includes a burner 42a having a discharge end registering with the port 40d for discharging a mixture of particulate fuel, such as coal, and primary air into the interior 40f of the furnace. The burner assembly 42 is of a known design, such as disclosed in U.S. Pat. No. 5,107,776 which is incorporated by reference, and therefore will not be described in detail.

A sleeve 42b also registers with the port 40d and surrounds the discharge end portion of the burner 42a to define an annular passage 42c which receives pressurized air in a manner to be described. An inlet duct 43 registers with, and extends tangentially to, the burner 42a for introducing a mixture of pulverized coal and primary air into the burner. The mixture thus swirls in the interior of the burner 42a as it passes to the discharge end of the burner for discharge into the furnace interior 40f. It is understood that ignitors, or the like (not shown) are provided to initially ignite the fuel.

An inlet duct 44 is connected to a source of pressurized air and registers with an air plenum 48a which connects to an additional air plenum 48b through which the burner 42a extends. The air plenums 48a and 48b are defined in part by the furnace wall portions 40a, 40b and 40c and a common wall 50 which has an air flow opening 50a extending therethrough. A partition 52 is provided in the air plenum 48a and has an air flow opening 52a extending therethrough. Two dampers 54a and 54b are disposed in the openings 50a and 52a in the walls 50 and 52, respectively, for controlling the flow of air through the openings for reasons to be described.

An opening 40b' is provided in the wall portion 40b for discharging a portion of the air from the plenum 48a into the furnace interior 40f under control of the damper 54b, which air functions as secondary air. If the wall 40 is formed by a plurality of spaced water tubes as discussed above, the opening 40b' can be formed by bending one or more tubes out from the plane of the wall.

Another portion of the air from the plenum 48a passes into the plenum 48b under control of the damper 54a for discharging through the annular passage 42c. It is understood that dampers, vanes and the like could be provided in the annular passage 42c for receiving and controlling the flow of air into the furnace interior 40f in a combustion-supporting relationship with the fuel discharging from the burner 42a, with the latter air functioning a tertiary air.

A duct 58 has one end in registry with the upper portion of the burner 42a for receiving a portion of the fuel/primary air mixture vented from the burner and extends to and through an overfire air plenum 60 mounted adjacent the wall portion 40a. A damper 59 is disposed in the duct 58 for controlling the flow of the fuel/primary air mixture through the duct 58. The discharge end of the duct 58 registers with the port 40c, and a sleeve 62 extends around the discharge end portion of the duct to define an annular passage 64 therebetween. Thus, a portion of the fuel/primary air mixture vented from the burner 42a passes through the duct 58 under control of the damper 59, and discharges into the furnace interior 40f through the port 40c at an area above the location where the burner 42a discharges the remaining portion of the fuel primary air mixture.

An inlet duct 66 registers with an opening in a wall of the plenum 60 for introducing overfire air, preferably from the same source as the air for the duct 44, into the plenum. A partition 68 is provided in the plenum 60 and has two openings 68a and 68b extending therethrough in which are disposed dampers 70a and 70b, respectively. Thus, the flow of air through the opening 68a is controlled by the damper 70a before it enters the annular passage 64 and discharges into the furnace interior 40f. A plurality of swirl vanes 72 are angularly spaced around the annular passage 64 for imparting a swirl to the air passing through the passage before the air discharges into the furnace interior 40f. To this end, it is understood that the vanes can be adjustable to vary the swirl, in a conventional manner.

A duct 74 connects the opening 68b to the interior of the duct 59 to pass air from the plenum 60 into the duct 59 under control of the damper 70b. The latter air mixes with the vented fuel/primary mixture passing through the duct 59 and discharging through the port 40c into the furnace interior 40f.

In operation of the embodiment of FIG. 2, a mixture of particulate fuel and primary air from an external source is introduced into the conduit 43. Due to the momentum of the particulate fuel and the tangential alignment of the conduit 43 with the burner 42a, the mixture is separated into a fuel-rich portion which swirls around within the interior of the burner 42a and is propelled by centrifugal forces against the inner wall of the burner leaving a fuel-deficient, air-rich portion in the center of the burner. The flow of the fuel/primary air mixture propels the fuel-rich portion of the mixture downwardly along the inner surface of the burner 42a and then out through the discharge end of the burner, through the port 40d, and into the furnace interior 40f. The air-rich portion of the mixture also discharges through the central portion of the discharge end of the burner 42a, through the port 40d, and into the furnace interior 40f. The fuel is initially ignited to cause continuous combustion of the fuel, with the primary air supporting the combustion.

Air from the inlet duct 44 is introduced into the plenum 48a and a portion of the air passes through the opening 52a in the partition 52 under control of the damper 54b and exits through the wall openings 40b' into the furnace interior 40f. This air functions as secondary air and the amount discharged into the furnace interior 40f, along with the amount of primary air discharged through the burner 42a as discussed above, is less than that required for complete combustion.

The remaining portion of the air in the plenum 48a passes into the plenum 48b under control of the damper 54a before passing through the annular passage 42c and the port 40d, and into the furnace interior 40f. This air functions as tertiary air and, as such, also supports the combustion of the fuel discharging from the burner 42a but is also insufficient to achieve complete combustion, thus maintaining reducing conditions in the furnace interior to minimize the formation of nitrous oxides. The combustion gases, along with the incompletely combusted fuel, rise in the furnace interior 40f towards the port 40c.

The damper 59 is adjusted to vent, or bleed off, a portion of the air-rich portion of the fuel/air mixture in the center of the interior of the burner 42a which portion passes through the duct 58 and discharges into the furnace interior 40f through the port 40c, where the relatively small quantity of fuel in the mixture combusts. Additional secondary, or over-fire, air, preferably from the same source that supplies the secondary air and the tertiary air to the duct 44, is introduced, via the duct 66, into the plenum 60. A portion of this air passes through the opening 68b in the partition 68 under control of the damper 70b, through the duct 74, and into the interior of the duct 58 where it mixes with the vented fuel/air mixture and is discharged, with the latter mixture, through the port 40c and into the furnace interior 40f. The amount of fuel/air mixture and air introduced into the furnace interior 40f through the duct 58 is adjusted by the dampers 59 and 70b, respectively.

The remaining portion of the air in the plenum 60 passes through the opening 68a in the partition 68 under control of the damper 70a, and into the annular passage 64 and is swirled by the vanes 72 before discharging through the port 40c and into the furnace interior 40f in an annular flow stream surrounding the flow stream of fuel and primary air from the duct 58. The design of the duct 58 and the passage 64 are the same as the embodiment of FIG. 1, that is the discharge area of the duct, defined by its diameter, is greater that the discharge area of the annular passage Thus, as in the embodiment of FIG. 1, the fuel/primary air mixture discharging into the furnace interior 40f from the duct 58 is relatively high in volume and low in velocity, while the additional secondary, or overfire, air from the passage 64 is relatively low in volume and relatively high in velocity. The dampers 70a and 70b are is adjusted so that the total volume of the overfire air introduced into the furnace interior 40f through the port 40c is sufficient to complete the combustion of the fuel.

Thus the embodiment of FIG. 2 enjoys all of the advantages of the embodiment of FIG. 1 including the ability to adjust the relative volumes and velocities of the fuel/air mixture and the overfire air introduced into the furnace interior 40f through the port 40c as needed. Also, the air portion of the mixture is relatively warm and does not disturb the main combustion of the fuel introduced by the burner 42a through the port 40d. Further, the fuel portion of the fuel/air mixture discharging through the port 40c is relatively easy to burn which further reduces the formation of nitrous oxides.

An alternate configuration of the discharge end portion of the duct 58 is shown by the dashed lines in FIG. 2 and the reference numeral 58a. More particularly, the latter discharge end portion is shaped into a venturi configuration which, in accordance with conventional principles, creates a low pressure zone at the throat of the venturi when the air from the duct 74 passes through the throat. This promotes the flow of the vented fuel/air mixture through the duct 58 for discharge into the furnace interior 40f in the manner discussed above.

It is also understood that several other variations may be made in the foregoing without departing from the scope of the present invention. For example, each port, duct, nozzle, burner, sleeve and passage discussed in each embodiment does not necessarily have to be circular in cross-section, but rather can take other cross-sectional shapes. Also, the system of the present invention can be used with a spreader stoker, or a fluidized bed combustor, firing crushed solid fuel, instead of the burner assemblies discussed above. Further, water can be sprayed into the duct 58 to form the known chemical radicals that further reduce the formation of nitrous oxides Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. An air control system for introducing air into an opening in the wall of a furnace to support the combustion of fuel in the furnace, the system comprising a first plenum for receiving air from a source, an inner member for receiving air from the first plenum and discharging the air through the opening and into the furnace, a second plenum for receiving air from the first plenum, an outer member extending around the inner member to define a passage between the members for receiving air from the second plenum and discharging the air through the opening and into the furnace, and a plurality of dampers for controlling the air passing from the first plenum to the inner member and for controlling the air passing from the second plenum to the passage, the cross section of the inner member being different than that of the passage so that the air discharged from the inner member is a different volume and velocity when compared to the air discharged from the passage.

2. The system of claim 1 wherein the mixture discharged from the inner member is at a relatively high volume and low velocity when compared to the air discharged from the passage.

3. An air control system for introducing air into an opening in the wall of a furnace to support the combustion of fuel in the furnace, the system comprising a first plenum for receiving air from a source, an inner member, a duct connecting the first plenum to the inner member to supply air from the first plenum to the inner member, the inner member discharging the air through the opening and into the furnace, a second plenum for receiving air from the first plenum, and an outer member extending around the inner member to define a passage between the members for receiving air from the second plenum and discharging the air through the opening and into the furnace, the cross section of the inner member being different than that of the passage so that the air discharged from the inner member is at a different volume and velocity when compared to the air discharged from the passage.

4. The system of claim 3 wherein the outer member is disposed in the second plenum for receiving the air from the second plenum.

5. The system of claim 4 wherein two opening are formed through the common wall to permit air to pass therethrough.

6. The system of claim 5 further comprising a duct connecting one of the openings to the inner member, and wherein the other opening permits the air from the first plenum to pass into the second plenum and to the passage.

7. The system of claim 6 wherein the cross section of the inner member is the cross section of the other end of the nozzle, and the cross section of the passage is the cross section of the discharge end of the annular passage.

8. The system of claim 5 further comprising two dampers associated with the two openings, respectively for controlling the flow of air through the openings.

9. The system of claim 5 wherein the outer member is in the form of a sleeve extending in a spaced relation to the inner member to define an annular passage therebetween having one end for receiving the air and another end for discharging the air.

10. The system of claim 3 wherein the mixture discharged from the inner member is at a relatively high volume and low velocity when compared to the air discharged from the passage.

11. A combustion system comprising a furnace having two spaced openings, a burner assembly for receiving and discharging a fuel/air mixture along with secondary air into the interior of the furnace through one of the openings, a duct extending from the burner assembly to the other opening and into the interior of the furnace for venting a portion of the fuel/air mixture from the burner assembly through the other opening and into the interior of the furnace, and an outer member extending around the duct to define a passage between the outer member and the duct which receives and discharges air through the other opening and into the interior of the furnace, the cross section of the duct being different than that of the passage so that the mixture discharged from the duct is at a different volume and velocity when compared to that of the air discharged from the passage.

12. The system of claim 11 further comprising a damper for controlling the amount of fuel/air mixture discharged by the burner assembly and the amount of fuel/air mixture vented to, and discharged by, the duct.

13. The system of claim 11 wherein the discharge end portion of the duct is configured to create a low pressure zone to promote the flow of the vented fuel/air mixture portion through the duct and to the opening.

14. The system of claim 11 wherein the mixture discharged from the duct is at a relatively high volume and low velocity when compared to the air discharged from the passage.

15. The system of claim 11 wherein the secondary air discharged by the burner assembly and the secondary air discharged through the passage are from the same source.

* * * * *